United States Patent [19]

Glova

[11] Patent Number: 4,556,496

[45] Date of Patent: Dec. 3, 1985

[54] REFRIGERATION LUBRICATING OIL CONTAINING DIALKYL SULFOSUCCINATE

[75] Inventor: David J. Glova, Hercules, Calif.

[73] Assignee: Chevron Research Company, San Francisco, Calif.

[21] Appl. No.: 594,071

[22] Filed: Mar. 28, 1984

[51] Int. Cl.[4] ..... C10M 3/34

[52] U.S. Cl. ..... 252/33; 252/48.6

[58] Field of Search ..... 252/33, 48.6

[56] References Cited

U.S. PATENT DOCUMENTS

| | | | |
|---|---|---|---|
| 2,028,091 | 1/1936 | Jaeger | 252/33 |
| 3,408,297 | 10/1968 | Sheldahl | 252/33 |
| 3,642,634 | 2/1972 | Olund | 585/11 |
| 3,733,850 | 5/1973 | Olund | 585/10 |
| 4,046,533 | 9/1977 | Olund | 585/19 |
| 4,199,461 | 4/1980 | Olund | 252/49.8 |

FOREIGN PATENT DOCUMENTS 0071410 2/1983 European Pat. Off. .

*Primary Examiner*—William R. Dixon, Jr.
*Assistant Examiner*—Cynthia A. Prezlock
*Attorney, Agent, or Firm*—J. A. Buchanan, Jr.; C. J. Caroli

[57] ABSTRACT

A refrigeration lubricating oil composition comprising a branched-chain alkylbenzene or mixture of branched-chain alkylbenzenes containing a total of from 10 to 25 carbon atoms in the alkyl groups, and about 50 ppm to 5 weight percent of a dialkyl sulfosuccinate wherein each alkyl group has 3 to 7 carbon atoms.

7 Claims, No Drawings

REFRIGERATION LUBRICATING OIL CONTAINING DIALKYL SULFOSUCCINATE

BACKGROUND OF THE INVENTION

The present invention relates to a refrigeration lubricating oil. More particularly, this invention concerns a refrigeration lubricating oil composition comprising a branched-chain alkylbenzene component and a dialkyl sulfosuccinate component.

Branched-chain alkylbenzenes are widely used as lubricating oils for compressors in refrigerators. See, for example, U.S. Pat. Nos. 3,642,634; 3,733,850; 4,046,533; and 4,199,461. However, it has been found that the use of branched-chain alkylbenzenes as lubricating oils often causes compressors to run noisier than when using a naphthenic mineral lubricating oil. This is due, at least in part, to the lower foaming tendency of branched-chain alkylbenzenes, since foam is seen to behave as a noise insulator.

Japanese Pat. No. J58-069,298 discloses a lubricating oil for refrigerators which is described as a hard alkylbenzene type or ester type synthetic oil containing a silicone oil having a dimethyl polysiloxane structure. The addition of dimethyl polysiloxane to the synthetic oil is taught to cause frothing in the oil and a reduction in the noise of the compressor.

SUMMARY OF THE INVENTION

The present invention provides a refrigeration lubricating oil composition comprising:

(A) a branched-chain alkylbenzene or mixture of branched-chain alkylbenzenes, each having one or more branched side chains of 5 to 25 carbon atoms and each containing a total of from 10 to 25 carbon atoms in the alkyl groups; and (B) about 50 ppm to 5 weight percent of a dialkyl sulfosuccinate of the formula

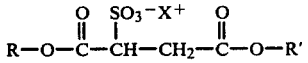

wherein R and R′ are independently alkyl or cycloalkyl of 3 to 7 carbon atoms; and X is selected from the group consisting of hydrogen, lithium, sodium, potassium and ammonium.

Among other factors, the present invention is based on my discovery that the addition of certain low molecular weight dialkyl sulfosuccinates to branched-chain alkylbenzenes promotes foaming in the alkylbenzene and effectively decreases the noise level of compressors lubricated with such alkylbenzenes. This is particularly surprising in view of the fact that the dialkyl sulfosuccinates presently employed have a molecular weight at the lower end of the detergent range and, furthermore, are being utilized in a non-aqueous system.

DETAILED DESCRIPTION OF THE INVENTION

The alkylbenzene used in preparing the lubricating oil composition of the invention is a branched-chain alkylbenzene having one or more branched side chains of 5 to 25 carbon atoms and containing a total of from 10 to 25 carbon atoms in the alkyl groups. Mixtures of alkylbenzenes are also contemplated for use in the present invention.

The alkyl group of the alkylbenzene in the compositions of the invention must be branched, having at least one branch per every five, preferably four, carbon atoms. The most preferred alkyl group is one having one branch per every three carbon atoms and is prepared by polymerization of propylene. In the alkyl chain, branching is determined by dividing the number of carbon atoms connected to three other carbon atoms plus two times the number of carbon atoms connected to four other carbon atoms by the total number of carbon atoms in the alkyl groups.

Alkylbenzenes for this use are prepared by alkylating benzene with an alkylating agent in the presence of a catalyst. Typical alkylating agents are the branched-chain olefins or branched-chain halides, preferably chlorides. The preferred method of preparation is by the HF catalyzed reaction of benzene with a branched chain olefin.

Satisfactory alkylbenzenes have an average molecular weight in the range of 300 to 470 and can be prepared from the following branched-chain olefins:

hexapropylene;

pentaisobutylene;

a mixed $C_{16}$-$C_{28}$ polypropylene-polyisobutylene blend;

oligomers of propylene and the 4 to 9 carbon atom 1-olefins in a mol ratio greater than 75/25, respectively;

4,6-dimethyl-8-isobutyl-3-dodecene;

2,4-dimethyl-5-isobutyl-5-dodecene;

4,6,8,12-tetramethyl-10-ethyl-9-tridecene;

2,4,6,8,10-pentamethyl-2-tridecene;

2,6,8,10,12-hexamethyl-2-pentadecene;

4,6,8,10-tetramethyl-2-hexadecene;

4,6,8,10,12,14-hexamethyl-2-nonadecene;

2,4,6,8,10,12-hexamethyl-12-eicosene;

2,4,6,6,8,10,10,12-octamethyl-2-tridecene, etc.

The preferred olefin is a blend of polypropylene having from 15 to 24 carbon atoms. The preferred alkylbenzenes have a molecular weight in the range of 325 to 415.

The alkylbenzene mixtures of this invention have viscosities in the range of 80 to 800 SUS (measured at 100° F.), preferably in the range of 150 to 500. Three viscosity grades of lubricants are conventionally supplied for use in a refrigeration apparatus: 150 SUS, 300 SUS and 500 SUS. The mixtures of alkylbenzenes herein described may be tailored to any one of these three grades, but the 150 SUS grade is preferred and is obtained from branched-chain alkylbenzenes produced by HF alkylation of benzene with mixed polypropylenes and having an average molecular weight in the range of 330 to 350. The alkylbenzenes are primarily mono-substituted alkylbenzene, but may contain minor proportions of polyalkylaryl hydrocarbons within the aforesaid molecular weight ranges. The alkylbenzenes preferably are dried to contain not more than 30 parts per million of water. Such drying may be accomplished by conventional means such as blowing with an inert gas, including air, nitrogen, helium, etc., and may be accomplished in connection with other treatment, for example, clay treatment, preferably acid-treated clay, used to remove various impurities.

The dialkyl sulfosuccinate employed in the lubricating oil composition of the invention has the general formula

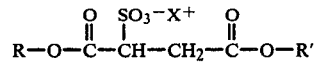

wherein R and R′ are independently alkyl or cycloalkyl of 3 to 7 carbon atoms; and X is selected from the group consisting of hydrogen, lithium, sodium, potassium and ammonium. Preferred dialkyl sulfosuccinates are those wherein R and R′ are both n-amyl or n-hexyl. Preferred sulfosuccinate salts are those wherein X is sodium. The dialkyl sulfosuccinates are generally present at a concentration in the range of about 50 ppm to 5 weight percent (50,000 ppm), and preferably in the range of about 100 ppm to 500 ppm.

The dialkyl sulfosuccinates are commonly available materials which are generally prepared by reacting succinic anhydride with sulfur trioxide and esterifying the resulting product to form the dialkyl esters. The sulfosuccinate salts are prepared from the corresponding sulfonic acid by careful neutralization with alkali metal or ammonium hydroxide.

In addition to the dialkyl sulfosuccinate, the refrigeration lubricating oil of the invention may contain additives of the types conventionally used. These include viscosity improvers such as polybutene having viscosities in the range of from about 3,000 SUS to 1,000,000 SUS at 100° F.; metal deactivators such as alizarine, quinizarine, zinc dithiocarbamates, and mercaptobenzothiazole; oxidation inhibitors such as dibuty-p-cresol, scavengers for hydrogen chloride such as epoxides; and extreme-pressure lubricity additives such as tricresyl phosphate.

The following examples are provided to illustrate the invention in accordance with the principles of this invention but are not to be construed as limiting the invention in any way except as indicated by the appended claims.

EXAMPLE 1

The apparatus used in all test runs consisted of a pressure vessel containing a reservoir of refrigerant and fitted with a metering valve. The refrigerant line from the pressure vessel was connected to a precalibrated rotameter and then to a 24-inch (61 cm.) glass buret fitted with a sintered glass disk and a plastic stopcock.

The glass buret was cleaned by rinsing twice with hexane and then twice with acetone. For testing different lubricating oil compositions, the sintered glass disk was also cleaned by drawing hexane and acetone through it using a vacuum flask. The buret was then blown dry with air or nitrogen.

The lubricating oil composition was added to the 3-inch (7.6 cm.) mark on the buret. The refrigerant line was connected and the stopcock and refrigerant valves opened. The refrigerant flow rate was gradually increased to 240 ml/minute as measured by the rotameter. The refrigerant normally used was dichloro, difluoromethane.

Foam height was measured as a function of time. The foam height usually stabilized after 5 to 10 minutes, at which time the foam height measurement was made and recorded. See Table I. The refrigerant was then turned off and the time for the foam to collapse was measured. The foam decay time is also shown in Table I.

A predetermined amount of the test additive was dissolved in a branched-chain alkylbenzene prepared by the alkylation of benzene with polypropylene. The alkylbenzene had an average molecular weight of about 330, an alkyl chain length of 15 to 24 carbon atoms, and a viscosity of 150 SUS at 100° F. Then a sufficient quantity of this solution was added to the buret of the test apparatus, and foaming characteristics were determined as described above. The quantities tested and the results of each test are given in Table I.

The results shown in Table I demonstrate that the diamyl and dihexyl sodium sulfosuccinate additives significantly increased the foaming tendency of the branched-chain alkylbenzene, whereas the corresponding dioctyl sodium sulfosuccinate did not.

In addition, over 50 other compounds, including numerous surfactants, were tested by the same procedure and found to be ineffective as foaming additives for branched-chain alkylbenzenes.

In other experiments, it was found that 250 ppm of sodium diamyl sulfosuccinate in the branched-chain alkylbenzene oil significantly reduced the noise in a refrigerant compressor, as compared to the alkylbenzene oil with no additive.

TABLE I

Foam Height and Foam Stability

| Run No. | Additive | Amount, ppm | Foam Height, inches | Foam Decay Time, minutes |
|---|---|---|---|---|
| 1 | None | — | 0.5 | <0.1 |
| 2 | Sodium diamyl sulfosuccinate | 20,000 | >10 | 7 |
| 3 | Sodium diamyl sulfosuccinate | 2,300 | >10 | >15 |
| 4 | Sodium diamyl sulfosuccinate | 1,100 | >10 | >20 |
| 5 | Sodium diamyl sulfosuccinate | 250 | >10 | >20 |
| 6 | Sodium diamyl sulfosuccinate | 111 | >10 | 10 |
| 7 | Sodium diamyl sulfosuccinate | 24 | 1.5 | 3.5 |
| 8 | Sodium dihexyl sulfosuccinate (80% with 20% water) | 1,060 | >10 | >20 |
| 9 | Sodium dihexyl sulfosuccinate (80% with 20% water) | 501 | >10 | >20 |
| 10 | Sodium dioctyl sulfosuccinate | 20,000 | 1 | <0.1 |
| 11 | Sodium dioctyl sulfosuccinate | 15,000 | 0.5 | <0.1 |
| 12 | Sodium dioctyl sulfosuccinate | 10,000 | 0.5 | <0.1 |
| 13 | Sodium dioctyl sulfosuccinate | 1,050 | 0.5 | <0.1 |
| 14 | Sodium dioctyl sulfosuccinate | 500 | 0.5 | <0.1 |

What is claimed is:

1. A refrigeration lubricating oil composition comprising:

(A) a branched-chain alkylbenzene or mixture of branched-chain alkylbenzenes, each having one or more branched side chains of 5 to 25 carbon atoms and each containing a total of from 10 to 25 carbon atoms in the alkyl groups; and (B) about 50 ppm to 5 weight percent of a dialkyl sulfosuccinate of the formula

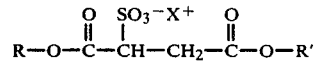

wherein R and R′ are independently alkyl or cycloalkyl of 3 to 7 carbon atoms; and X is selected from the group consisting of hydrogen, lithium, sodium, potassium and ammonium.

2. The composition according to claim 1, wherein R and R′ are both n-amyl.

3. The composition according to claim 1, wherein R and R′ are both n-hexyl.

4. The composition according to claim 1, wherein X is sodium.

5. The composition according to claim 1, wherein the dialkyl sulfosuccinate is present at a concentration in the range of about 100 ppm to 500 ppm.

6. The composition according to claim 1, wherein the branched-chain alkylbenzene or mixture of branched-chain alkylbenzenes is obtained by alkylating benzene with a branched-chain olefin.

7. The composition according to claim 6, wherein the branched-chain olefin is polypropylene having from 15 to 24 carbon atoms.

* * * * *